United States Patent [19]

Nitsch

[11] Patent Number: 5,001,956

[45] Date of Patent: Mar. 26, 1991

[54] KNIFE FOR PERFORATING PLASTIC SHEET MATERIAL

[76] Inventor: J. Leonard Nitsch, 110 Hampshire Rd., Syracuse, N.Y. 13203

[21] Appl. No.: 397,527

[22] Filed: Aug. 23, 1989

[51] Int. Cl.[5] ..... B26F 1/02

[52] U.S. Cl. ..... 83/620; 83/660; 83/695; 493/238; 493/372; 493/468

[58] Field of Search ..... 30/355, 357, 358, 366; 83/660, 689, 695, 30, 18, 140, 678, 620; 493/194, 197, 198, 238, 327, 468

[56] References Cited

U.S. PATENT DOCUMENTS

| | | | |
|---|---|---|---|
| 1,453,200 | 4/1923 | Stacho . | |
| 1,660,387 | 2/1928 | Masel . | |
| 2,002,812 | 5/1935 | Hansen | 51/105 R |
| 2,537,555 | 1/1951 | Sloan | 30/355 |
| 2,596,851 | 5/1952 | Hansen | 30/355 X |
| 2,636,267 | 4/1953 | Whitcomb | 30/355 |
| 2,956,465 | 10/1960 | Mingo | 83/660 |
| 2,959,081 | 11/1960 | Vysansky | 83/386 |
| 3,203,295 | 8/1965 | Sauer | 83/673 |
| 3,277,764 | 10/1966 | Henc | 83/679 |
| 3,795,163 | 3/1974 | Armstrong et al. | 83/30 |
| 3,824,887 | 7/1974 | Marchard | 83/679 |
| 3,828,631 | 8/1974 | Spengler et al. | 83/20 |
| 3,841,189 | 10/1974 | Spengler et al. | 83/660 |
| 3,956,824 | 5/1976 | Francis | 30/220 |
| 4,193,189 | 3/1980 | Marin | 30/260 |
| 4,358,979 | 11/1982 | Kurzbuch | 83/658 |
| 4,584,917 | 4/1986 | Blom | 83/329 |
| 4,620,467 | 11/1986 | Margraf et al. | 83/389 |
| 4,706,533 | 11/1987 | Giulie | 83/599 |
| 4,729,274 | 3/1988 | Marbach | 83/684 |
| 4,754,677 | 7/1988 | McKindary | 83/697 |
| 4,852,442 | 8/1989 | Pottorff | 83/695 |
| 4,891,885 | 1/1990 | Fischer et al. | 30/355 |

*Primary Examiner*—Hien H. Phan
*Assistant Examiner*—Kenneth E. Peterson
*Attorney, Agent, or Firm*—Wall and Roehrig

[57] ABSTRACT

A device for perforating a tubular film of plastic material flattened to form a roll of pre-formed bags for individual separation from the roll, has a perforating knife with a plurality of pointed teeth spaced along the bottom edge thereof disposed for reciprocal piercing of a continuous tubular film of plastic passed over a work support surface having a hollow slot therein. The teeth are hollow-ground to provide a slightly arcuate cutting edge along each tooth that produces a non linear perforation in the tubular film of plastic and partially separates the top layer of the plastic from the bottom layer. The teeth are spaced apart a desired distance to leave sufficient attaching tabs so that the roll of bags does not prematurely pull apart. Minimum tension and penetrating pressure are achieved with the present invention and result in less distortion and unwanted tearing of the end product and greater life for the piercing blade and a more easily separated and opened bag.

3 Claims, 1 Drawing Sheet

KNIFE FOR PERFORATING PLASTIC SHEET MATERIAL

BACKGROUND OF THE INVENTION

This invention relates generally to blades for cutting and perforating plastic films and more particularly to a blade for perforating thermoplastic films in the manufacturing of plastic bags.

In the manufacture of bottom sealed thermoplastic bags, it is necessary to process the bag through an apparatus which produces a heat seal and an adjacent perforated line across the tubular film. The heat seal provides the bottom closure for one bag and the perforations permit the adjacent bag to be separated by tearing along the perforations. The perforated web must have sufficient strength in the remaining tabs to maintain integrity until it is desired to separate the bags.

One common technique for heat sealing and perforating the bags is to index the tubular film as it emerges from the blown film extrusion system through an in-line bag machine, which is provided with a reciprocating serrated blade and sealing element. With a portion of the flattened tubular film positioned in the bag machine, the blade and heat sealing assembly is actuated. The assembly moves downwardly to cause the heating element to engage the film and the blade to penetrate the film. The assembly then moves upwardly to the retracted position permitting the film to be indexed to the next position, wherein the heat sealing and perforation cycle is repeated. A commercially available machine that operates in this manner is the Gloucester Universal Bag Machine, marketed by Gloucester Engineering Co., Inc., located in Gloucester, Mass.

The in-line bag machine, as described above, functions satisfactorily for many types of film such as low density polyethylene (LDPE) film. However, it has been found that machines of this type are not entirely satisfactory for linear low density polyethylene (LLDPE) film in that the blade must be carefully maintained to provide satisfactory penetration. When the blade becomes even slightly dulled, it tends to push the film downwardly into the slot underlying the film and aligned with the cutting blade, resulting in incomplete perforations or if the film is fully supported in the underlying slot, it tends to weld together the edges of the slit formed by the blade penetration. Moreover, the downward pushing action increases the film tension in the heat sealing region and adversely affects the quality of the seal attainable.

OBJECTS AND SUMMARY OF THE INVENTION

The purpose of the present invention is to provide an improved method for perforating the plastic film used to manufacture plastic bags and an improved blade and apparatus for perforating tubular film. In the present invention applicant provides a unique blade form for piercing the plastic together with a film hold-down device that results in a transverse line of semi-arcuate perforations across the film. This results in easy separation of one bag from the next, and also pre-works the perforation itself to partially separate the two layers of film rather than weld them together as frequently has happened in the past so the separated bag may be easily opened. Applicant has provided a specially formed blade having a series of spaced pointed teeth that are hollow ground to form an arcuate cutting edge on each side of the tooth point for each slit. By paying close attention to the configuration of the teeth of the piercing blade and the method of manufacturing the same, applicant is able to provide a system for perforating the tubular plastic film with a minimum of penetration pressure which allows minimum hold down pressure of the film and permits the formation of the largest possible arcuate slit that tends to separate the top layer from the bottom layer of the tubular film. With the hollow ground tips of applicant's piercing blade, as the tip penetrates the plastic film the increasingly curving effective cutting edge of the blade tends to push the upper layer of plastic laterally along the lower layer of film to actually separate the upper layer from the bottom layer of the tubular film in the perforation area, rather than mash them together as has happened in the past.

Accordingly, it is an object of the present invention to provide an improved blade for perforating a film of thermoplastic for forming plastic bags.

It is another object of the present invention to provide an improved method for the perforating of tubular films of plastic to form bags therefrom.

It is another object of the present invention to provide a blade for perforating tubular films of plastic having a special configuration tip that tends to separate the upper and lower films of the tube rather than mash them together.

It is a still further object of the present invention to provide an apparatus and method for perforating films of plastic material that greatly reduces the penetrating pressure and tension required to perform the operation.

These and other and further objects of the present invention, together with additional features and advantages accruing therefrom will be apparent from the following description of a preferred embodiment of the invention shown in the accompanying drawings, wherein:

DETAILED DESCRIPTION OF THE PREFERRED EMBODIMENT

Figure 1:
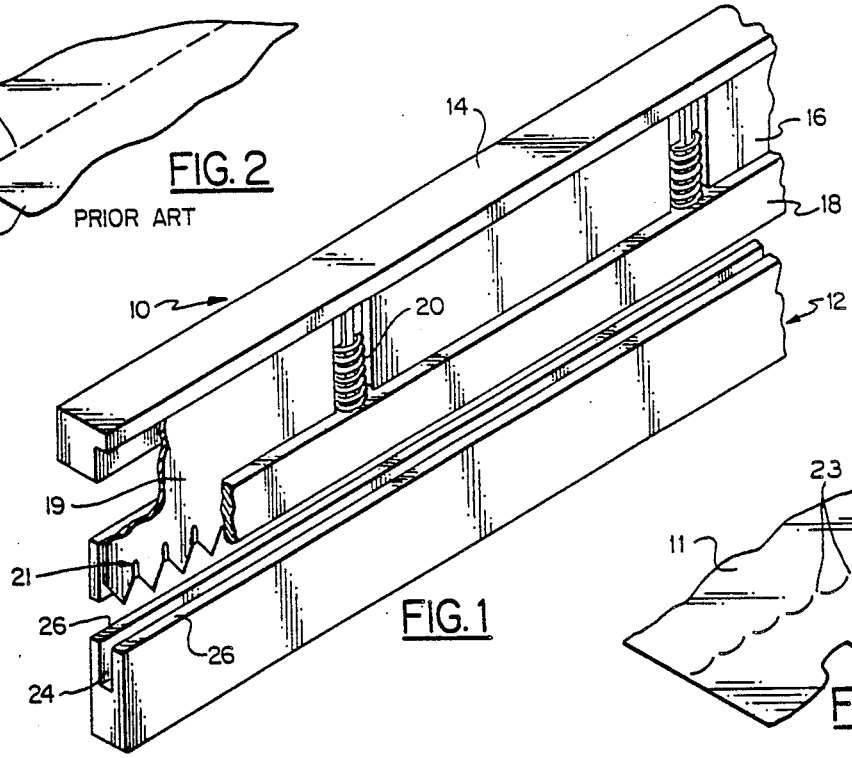
FIG. 1 is a perspective view of a device for perforating tubular plastic film in accordance with the present invention.

Referring now to FIG. 1 there is shown a cutting apparatus according to the present invention which consists generally of an upper assembly 10 and a lower bar assembly 12 mounted in a frame, not shown, for alignment with each other. The upper assembly 10 comprises a bar 14 on which is mounted the blade 16 according to the present invention. Also mounted on either side of the blade 16 are hold down members 18 which are spring-biased in the downward direction by springs 20 mounted in slots 22 in the blade member 16. This general configuration is well-known in the prior art and shown in Kurzbuch U.S. Pat. No. 4,358,979.

The lower bar assembly 12 comprises a longitudinal groove 24 in the middle of a pair of work support surfaces 26 which are contacted by the hold down members 18 to hold the film in place as the piercing blade assembly is actuated to enter the open slot 24 to pierce the film.

Figure 2:
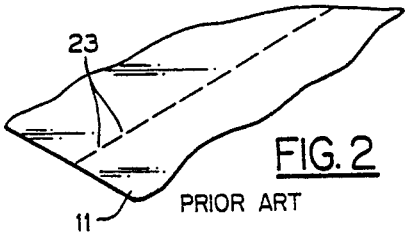
FIG. 2 PRIOR ART
FIG. 2 is a perspective view of a portion of tubular film perforated in accordance with the prior art.
Figure 3:
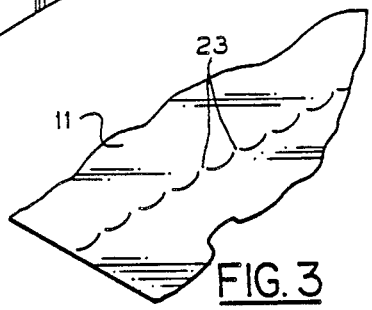
FIG. 3 is a view similar to FIG. 2 of a segment of tubular plastic film perforated in accordance with the present invention.
Figure 4:
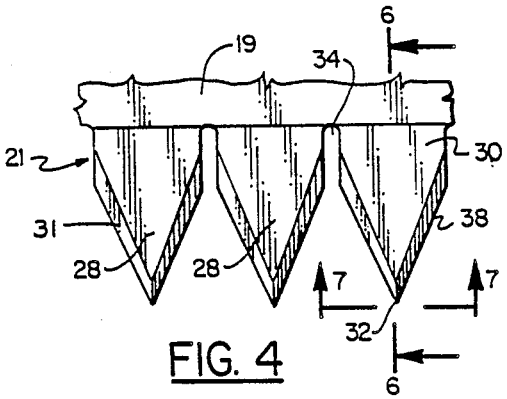
FIG. 4 is an enlarged detail view of the tooth portion of the blade of FIG. 1.
Figure 5:
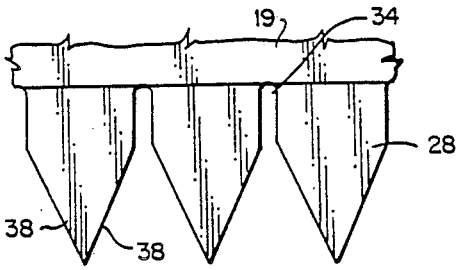
FIG. 5 is a similar enlarged scale partial view of the reverse side of FIG. 4.
Figure 6:
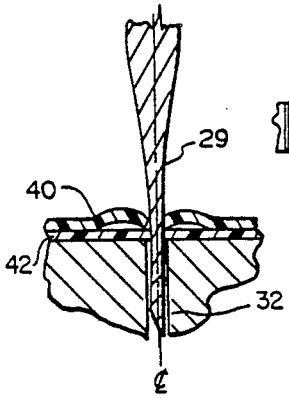
FIG. 6 is a sectional view taken on lines 6—6 of FIG. 4.

With devices of the prior art such as that cited above, the tubular film, after piercing, has exhibited a series of straight line perforations across the width thereof as shown in FIG. 2. These have been spaced apart by a preselected distance forming tabs 23 to insure that there still was sufficient strength to maintain integrity of a continuous web and yet allow separation when desired. This is to be contrasted with the perforations produced by applicant's invention which are shown in FIG. 3. As may be seen in FIG. 3, the perforations are semi-arcuate or slightly pointed triangular slits disposed in a transverse line across the tubular web of the bag material with tabs 23 between each pair of slits. Each slit has a center point where the tip of the tooth first penetrates the plastic and then a pair of legs that extend outwardly therefrom in a generally arcuate fashion to the width of the tooth which is determined by the depth of penetration into the plastic of the piercing blade and the actual width of the tooth itself. The blade 16 consists of an elongated flat bar with a shank portion 19 and a toothed edge portion 21 which carries along the edge thereof a plurality of teeth members 28. Referring to FIGS. 4–6, it can be seen that the teeth 28 have a root portion 30 and a tip 32 with the root portion 30 blending into the shank 19 as shown.

Prior art blades of the type involved in the present invention have generally been of the shape shown in FIGS. 4 and 5 but have been of constant thickness from the root portion to the tip, except for the sharpening bevel. In prior devices known to applicant the tooth portion 21 of the blade has been either the full thickness of the shank or, if a thinner toothed area is desired, the tooth portion has been surface ground to a thickness somewhat less than the shank portion but with the surfaces of each side of the tooth being parallel to each other and then the blade being bevel-sharpened as is customary in the art. This type of blade makes the straight linear slit as shown in FIG. 2.

Applicant's invention, on the other hand, requires that the two surfaces of the toothed portion 21 be hollow ground from the shank toward the tip on both sides to a very fine point configuration. As can be seen by the lines in both FIGS. 4 and 5, both surfaces of the teeth 28 have been hollow-ground in a vertical direction, that is from the shank towards the tip or vice versa by a grinding wheel typically having a diameter of twenty-four to twenty-eight inches. This provides a hollow grind on the tooth as shown in FIG. 6 and in one preferred form of the invention, equal material is ground off both sides of the tooth. When the teeth are bevel sharpened, the actual pointed chisel edge tip 32 of the tooth is offset from the center line of the shank as shown in FIG. 6. For greater curvature of the slits, a smaller diameter grinding wheel with a diameter from twelve to eighteen inches may be used.

In practice, a blank is stamped out from suitable steel material of approximately 0.042 inches thickness to the approximate shape shown in FIG. 5. This includes the pointed teeth 28 and the typically narrow grooves 34 provided between each pair of teeth to provide a connecting tab in the tubular film so that the bag is not totally severed from the continuous web of material After the blank is formed, the two sides of the teeth are hollow-ground to the configuration shown at 29 in FIG. 6 and then after that, the teeth on the side shown in FIG. 4 are bevel sharpened along each edge again by grinding in a vertical direction as shown in FIG. 4, i.e., from the shank toward the tip of the tooth or vice versa to sharpen the teeth for penetration into the plastic film. This produces cutting edges 38 which do the actual piercing and slitting of the continuous web of plastic film, as will be described in more detail herein. As may be seen in FIG. 5, the cutting edge extends from the chisel edge tip 32 to the entrance of the notch 34. The bevel 31, as shown in FIG. 4, extends most of the way up into the notch 34.

After the blades have been hollow-ground and sharpened as described in connection with FIGS. 4–6, they are then honed and burnished to remove all possible burrs and to smooth the edges of the teeth as much as possible without dulling them. In operation, it is essential that the teeth pierce the continuous web as easily as possible so as to minimize distortion, unwanted tearing and so forth. With prior art devices, the continuous web of tubular film 11 frequently has to be held under considerable tension as it is passed beneath the perforating knife, and in certain prior art devices, the hollow slot 24 has been filled with special supporting material that forms complete receptacles for the teeth of the perforating blade. This has been found necessary in some of the prior art devices in order to obtain clean slits in the tubular plastic This has, however, also tended to weld the edges of the slits together so that it makes it very difficult to open the tube after the bag is separated from a continuous roll of perforated bags.

According to the present invention, by providing these very finely sharpened teeth with all grind marks and other evidence of metal working oriented in the penetrating direction along the teeth, it has been found that the blade will easily penetrate the tubular plastic web. Much less pressure is required to effect this penetration. This permits perforation of the film with no back up directly underneath the piercing blade. In practice, a hollow slot 24, into which the blade teeth can move without interference, has been found best. This low tension and absence of back up also permits the curved hollow-ground cutting edges 38 of the teeth to actually form a slightly curved or check-mark shaped slit in the two layers of the tubular plastic material.

Figure 7:
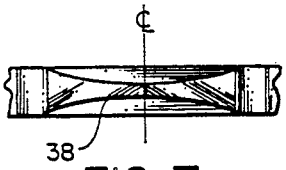
FIG. 7 is an end view taken on lines 7—7 of FIG. 4.

In addition to reducing the pressure needed to penetrate the plastic, the tooth configuration according to the present invention actually separates the top layers from the bottom layer of film as shown more particularly in FIG. 6. As the teeth penetrate the continuous web, the constantly expanding tooth thickness tends to push the upper layer of the plastic material 40 laterally along the lower layer 42 as shown in FIG. 6. Thus, along each slit the blade 16 tends to separate the two plies rather than weld them together as occurred in many of the prior art devices. This action, which is due to the expanding width of the tooth along a curved edge, plus the increasing thickness formed by the hollow grind, the beveled sharpening, and chisel edge tip 32, forms the semi-arcuate or slightly check marked perforations across the width of the tubular web of plastic from which the bags are made. In a preferred embodiment, according to the present invention, the blade 16 has a thickness of 0.042 inches and the teeth taper from the 0.042 inches at the shank down to approximately 0.008 to 0.010 inches at the tip. As described above, the taper is not a straight line taper, but rather an arcuate taper so that the cutting edge 38, is really not a straight line, but a curved line coming out of the plane of the paper in FIG. 5, assuming the tip 32 is in the plane of the paper. Viewed in a plane perpendicular to the blade such as the continuous web, each cutting edge is a small arc, as shown best in FIG. 7, which is a bottom end view of a tooth showing the tapered sharpening and the arcuate cutting edge 38 of one of the teeth in FIG. 4.

Figure 8:
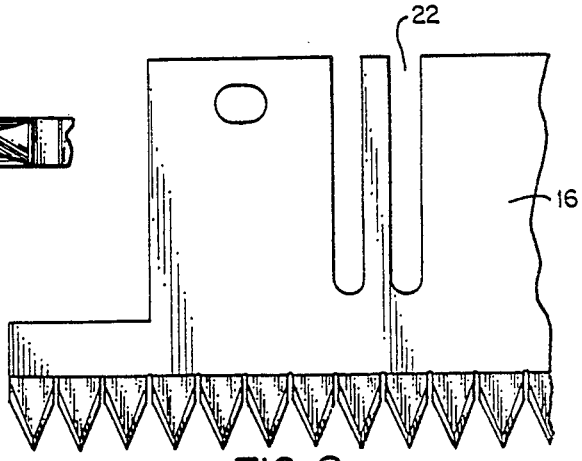
FIG. 8 is an enlarged fragmentary view of the blade as shown in FIG. 1.

Referring now to FIG. 8, there is shown a partial view of the end of a blade 16 showing the slot 22 which receives therein the springs 20 to urge the hold-down bar members 18 downwardly as a shield for the blade teeth, and also to hold the work in engagement with the work surfaces 26 of bar 12 when in operation. The blade 16 is secured to the bar 14 by suitable bolts, not shown.

It has been found that the blade of the present invention is most advantageously made of a cold rolled steel that can be hardened to a Rockwell 55 or 56, C scale, to provide long life for the piercing operation. It also has been found that by flash coating the blade with a chrome plate, as is well known in the art, the life of the teeth is increased and also the penetration of the plastic film facilitated It has been found that the blade of the present invention permits operation of the apparatus of FIG. 1 over a wide range of tensions of the continuous web 11 as it passes over the work surfaces 26. The pressure required to penetrate the plastic film is greatly reduced by the blade of the present invention which allows the continuous web to be fed through the apparatus of FIG. 1 at a lower tension. It has been found that if the tension of the web 11 to be perforated is too great, the arcuate perforations will not form and a cutting action, similar to the conventional blade will be obtained, in which the edges of the perforation are in effect, welded shut. With the improved blade configuration and the reduced penetration pressure, the action as described in connection with FIG. 6 will occur and the resultant perforation will be approximately as shown in FIG. 3. This configuration maintains the tensile integrity of the continuous web which may be formed into a roll of bags. The bags can be easily separated from the roll and the perforated end of the bag easily opened after separation because the two layers of the plastic have been at least partially separated along each slit.

In practicing the present invention, it should be understood that the precise shape of the perforations realized will depend in part on the tension of the web during penetration, the contour of the teeth as described above, the radius of curvature of the hollow grind of the teeth, the hold down pressure of the clamping bars 18 and the thickness and specific composition of the plastic tubular web material. The slits will vary somewhere from the arcuate to the shallow V-shape, depending upon the particular combination of parameters encountered. The important distinction from the prior art is that the configuration of the blade and penetration method of the present invention produce non linear perforations, i.e., other than a straight line and the rubbing action of the chisel edge tip and the blade itself, as it increases in thickness, during penetration of the plastic material, together with the arcuate cutting edges, push the top layer back from the slit and up from the lower layer producing a preopened condition of the bag when it is separated from the continuous web or roll of bags.

This concept may be incorporated in circular cutting blades that are sometimes used to form slits in continuous webs. Also, curved blades may be made in accordance with the present invention when a curved perforation for separating portions of a continuous web is desired.

While this invention has been explained with reference to the structure disclosed herein, it is not confined to the details as set forth and this application is intended to cover any modifications and changes, such as circular or curved perforating knives, as may come within the scope of the following claims.

I claim:

1. An elongated perforating blade for use in apparatus for forming tear perforations in a two-ply plastic material, said blade including a series of spaced apart triangular shaped teeth formed along a bottom edge of the blade, said teeth having front and back surfaces, each tooth having a thickness, a root, a tip that lies on a common line describing the bottom edge of the blade, and a pair of linear side edges that diverge uniformly from the tip toward the root, said side edges of adjacent teeth being separated by lateral edge grooves that extend upwardly into the blade beyond the roots of the teeth, said front and back surfaces of each tooth being hollow ground so that the thickness of the tooth decreases from the root of the tooth toward the tip, a bevelled surface extending along the linear side edges of each tooth to form a sharp cutting edge extending from the tip of the tooth to an adjacent edge groove, said bevelled surfaces combining at the tip to form a chisel edge tip that slopes obliquely and upwardly from the back surface toward the front surface of the tooth, whereby each tooth pushes a top sheet of the two-ply material over a bottom sheet as the tooth penetrates into the ply, thereby preventing the plies from sticking together as the tear perforations are being formed.

2. An elongated perforating blade in accordance with claim 1 wherein said bevelled surface extending along the linear side edges of each tooth is formed by bevel grinding the edges of said teeth in a direction parallel of the hollow grinding from the root to the tip.

3. An elongated perforating blade in accordance with claim 2 further including a flash chrome plated layer on at least the toothed edge portion of said blade, and each of said teeth being burnished and honed after bevel grinding.

* * * * *